United States Patent [19]

Beard

[11] Patent Number: 4,513,889

[45] Date of Patent: Apr. 30, 1985

[54] RECLOSABLE VALVE WITH REMOVABLE HERMETIC EXTERNAL SEAL MEANS

[76] Inventor: Walter C. Beard, South St., Middlebury, Conn. 06762

[21] Appl. No.: 452,953

[22] Filed: Dec. 27, 1982

[51] Int. Cl.[3] ..... B65D 55/08

[52] U.S. Cl. ..... 222/153; 222/182; 222/402.1; 222/542; 215/256; 220/257; 220/258; 220/270

[58] Field of Search ..... 222/153, 182, 541, 542, 222/562, 402.1, 402.21, 402.22; 220/85 P, 214, 276, 284, 270, 257, 258; 215/254, 255, 256

[56] References Cited

U.S. PATENT DOCUMENTS

| | | | |
|---|---|---|---|
| 2,709,111 | 11/1952 | Green | 222/402.22 |
| 2,731,298 | 3/1953 | Green | 239/337 |
| 2,737,416 | 3/1953 | Behr et al. | 239/121 |
| 2,947,451 | 5/1959 | Suellentrop | 222/182 |
| 3,048,307 | 8/1962 | Michell | 222/402.22 |
| 3,156,942 | 6/1963 | Nyden | 401/125 |
| 3,161,331 | 11/1962 | Murtha | 222/402.12 |
| 3,162,329 | 12/1964 | Gregory | 222/182 |
| 3,170,603 | 2/1965 | Kitterman | 222/182 |
| 3,179,313 | 4/1965 | De Malglaive | 222/541 |
| 3,180,532 | 4/1965 | Michel | 222/182 |
| 3,182,851 | 5/1965 | Taylor | 222/541 X |
| 3,233,788 | 2/1966 | Diamond | 222/182 |
| 3,266,676 | 8/1966 | McKernan | 222/182 |
| 3,334,769 | 10/1965 | Gach | 220/284 |
| 3,378,172 | 4/1968 | Nelson | 222/153 |
| 3,506,241 | 4/1970 | Ewald | 251/354 |
| 3,514,011 | 5/1970 | Madeira et al. | 220/284 |
| 3,565,295 | 2/1971 | Doyle | 222/182 |
| 3,690,519 | 9/1972 | Wassilieff | 222/182 X |
| 3,729,116 | 4/1973 | Green et al. | 220/307 |
| 3,791,551 | 2/1974 | Madeira | 220/307 |

*Primary Examiner*—H. Grant Skaggs
*Assistant Examiner*—Lawrence J. Miller
*Attorney, Agent, or Firm*—Hill, Van Santen, Steadman & Simpson

[57] ABSTRACT

A reclosable valve stem actuated valve structure for aerosol-type containers and the like is provided which has an external seal that includes a seal member, a bonding agent, and a separatable frangible zone. The external seal is installed after the valve structure is associated with a container and after a container filling operation of the type where filling is accomplished through the valve structure.

10 Claims, 11 Drawing Figures

RECLOSABLE VALVE WITH REMOVABLE HERMETIC EXTERNAL SEAL MEANS

BACKGROUND OF THE INVENTION

1. Field of the Invention

This invention lies in the field of valves actuated by stem movements and particularly to combination of such valves with independent removable hermetic external seal means.

2. Description of the Prior Art

In the art of aerosol-type valves, it is common for a reclosable valve assembly to be operated during opening and closing by means of the movement of the valve stem through application thereto of an appropriately applied external force, as from an operator's finger. Typically during operation, such a valve stem is moved or displaced (e.g., tilted or reciprocated) relative to its normally upright closed (typically axially aligned) position.

Especially when the fill of a pressurized container that is functionally associated with such a valve assembly (as the dispensing means) is sensitive to, or reactive with oxygen, water vapor, or other substances found in the atmospheric environment, it would be desirable to seal externally annd hermetically the valve assembly (relative to the fill in the container) until such time as the fill is to be dispensed and used. At such time, it would be desirable to open such seal permanently by means of an externally applied force after which the reclosable valve assembly can be opened and closed in typical fashion for dispensing the fill.

In the prior art, a variety of externally used valve protective cover means have been employed to adjoin a protective member with a valve body. Such mechanical means have included snap or force fits, screw-on arrangements, frictional fits, and the like. One class of such protective cover means comprises so-called tamperproof closures. So far as can be determined, in such prior art, there are no teachings or suggestions of using a separate bonding means to secure a protective cover to a valve for purposes of providing an hermetic seal over and about valve components in combination with a valve body with which the protection cover and bonding means are in gas-tight association. Furthermore, the prior art does not appear to provide such external seal structures which are additionally able to be opened by external force, thereafter to permit normal valve opening and closing operations to proceed to purposes of dispensing the pressurized fill of a valve-associated container.

Thus, so far as is now known, reclosable valve assemblies of the type operatable by valve stem movement have not previously been known which were provided with removable external hermetic seal means wherein a seal member is bonded in a gas-tight manner to a valve body after such valve body is mounted upon a container.

Previously, I have invented a class of reclosable valves operated by valve stem tilting which are provided with an external reclosable valve stem tip seal which is operated by valve stem tilting. This tip seal forms a second seal which protects material possibly retained in the stem from atmospheric action associated with valve stem tilting in a previous use; see Beard U.S. patent application Ser. No. 394,517, filed July 2, 1982, now U.S. Pat. No. 4,418,847, issued Dec. 6, 1983. However, because this tip seal is operated through the existence of an internal force it does not provide a hermetic seal of the class presently provided.

BRIEF SUMMARY OF THE INVENTION

By the present invention, there is provided a stem equipped, reclosable valve assembly of the type operated by a valve stem which moves relative to a valve body, such valve assembly being provided with an external sealing member, a bonding means, a frangible zone, and an optional or auxiliary frangible zone opening means. The valve assembly is initially associated with a container.

The external sealing means is gas impermeable and is initially secured to the valve assembly after such is associated with the container. A portion of such valve body (which itself is also gas impermeable) is secured to this sealing means by the bonding means which thus maintains such sealing member in a gas-tight relationship with such valve body. The frangible zone is located in (a) such external sealing member, (b) such bonding means, and/or (c) some adjacent region therebetween, and the frangible zone extends along a closed pathway which generally circumscribes the region around the valve stem. The frangible zone opening means can include a tab means that is associatable with such external sealing means through which an externally applied force is locally exertable against such sealing member in a region thereof preferably adjacent such frangible zone. When such localized force is sufficiently great, a localized breaking or separation is initiated in such frangible zone, and then is continued, thereby permitting the external sealing member to be removed in the region of the closed pathway defined by the frangible zone, and thereby opening such sealing member at least in the region of the valve stem and permitting a pressurized fill to be dispensable from the container functionally associated with such valve through the valve stem thereof during normal valve assembly operating and closing operations.

The present invention provides in one aspect a significant advance in the art of aerosol-type valves by providing the capacity for long shelf-life storage of container fills sensitive to atmospheric gases (including moisture) through the provision of an externally openable hermetic external seal means functionally associated with the body of such a valve.

In another aspect, the present invention provides a reclosable valve assembly which, after an external hermetic seal in functional association therewith is opened, can be opened and closed at will by a valve user.

In another aspect, this invention provides a reclosable valve structure for pressurizable containers and the like which valve structure incorporates initially an hermetic external seal means and an optional associated externally operated external seal removing means, and which valve structure can be preassembled, then bulk stored with other such structures in a common container, and next mounted on such a container followed by container charging, generally without any substantial danger to the sealing integrity of such external seal means and to such external seal removing means.

In another aspect of the present invention, there is provided a reclosable valve structure which can be first preassembled, then bulk stored with other structures in a common container, and next mounted on such a container, followed by container charging after which the valve structure can fitted with a hermetic removable seal member which is bonded to the body of the valve structure, thereby to provide a removable external seal in combination with such reclosable valve structure.

In another aspect, the present invention provides an initially externally hermetically sealed, stem-actuated, pressurizable valve assembly which valve assembly can be intentionally unsealed before valve use and which is characterized until unsealing by substantial freedom from the possibility of inadvertent or premature unsealing caused by vibration, shock, aging, or the like, particularly when the valve assembly is in functional association with a container that has been charged with a pressurized fill.

In another aspect, the present invention provides a stem-operated valve assembly with external hermetic sealing means, such sealing means including a sealing plate member and a bonding means for such sealing plate means, such sealing means being unsealable by rupturing or breaking either such bonding means or such plate member through the application thereto of localized externally applied force.

In another aspect, the present invention provides a stem-equipped valve assembly with external hermetic sealing means involving a combination of (a) a sealing member comprised of sheet metal and having a coined closed pathway defined about a central portion thereof, (b) a tab means associated with said sealing member and adapted to permit application of localized force thereto at a location along such coined pathway, and (c) bonding means securing edge portions of such sealing member to a body portion of such valve assembly in a gas-tight relationship.

In another aspect, the present invention provides a reclosable valve with a separate external hermetic seal means and external seal removal means therefor which valve is optionally characterized by a capacity for very large flow therethrough after the external seal means is removed by use of such external seal removal means and the valve is opened.

In another aspect, the present invention provides a reclosable valve with both a separate removable external hermetic seal means and a removable internal seal means, the valve structure further being provided with integrally incorporated internal seal removing means, such reclosable valve being provided with a moveable valve stem member.

Other and further aspects, aims, objects, features, advantages, embodiments, uses, and the like will be apparent to those skilled in the art from the present specification taken with the accompanying drawings.

DETAILED DESCRIPTION

Figure 1:
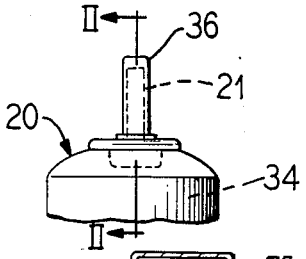
FIG. 1 is a fragmentary view of an aerosol-type container associated functionally with a valve assembly of the present invention.
Figure 2:
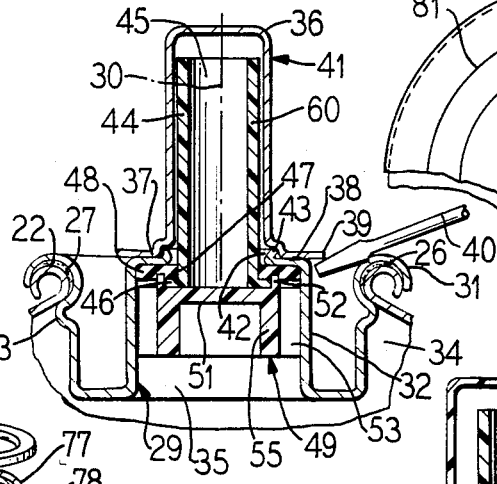
FIG. 2 is an enlarged vertical sectional view taken along the line II—II of FIG. 1 illustrating components of one embodiment of a valve assembly of the present invention.

Referring to FIGS. 1 and 2, a dispensing container or can 20 shown fragmentarily is fitted on its top end with a tilt valve structure 21 of the present invention. Container 20 is provided with an axially located aperture 27 having a rolled perimeter 22, container 20 being formed in this instance of sheet metal.

Container 20 is of conventional construction and forms no part of the present invention as such.

The tilt valve structure 21 includes a metallic mounting cup 29 which terminates in a rolled perimeter 31 that is adapted to make nesting engagement with the rolled perimeter 22. Interior surfaces of the roll 31 are provided with a coating 26 formed of a sealing material of resilient, elastomeric plastic composition, such as a chloroprene rubber composition, or the like, so that, when the mounting cup 29 is fitted over the roll 22 and formed by collet fingers, there is produced a retaining crimp 33 in cup 29, and the preformed valve structure 21 is thus sealingly associated with the container 20. Charging of container 20 with a pressurized fill is conventionally accomplished, as those skilled in the art will readily appreciate.

While the valve structure 21 is particularly well suited for the dispensing of a viscous fluid from a chamber 34 of the container 20, the valve structure 21, as those skilled in the art will readily appreciate, is also suitable for the dispensing of a viscous fluid which may have admixed therewith a gaseous propellant. When pressurized fluid material in the chamber 34 can react with oxygen, water vapor, or other substance in the atmosphere, or when such material can react with components of the valve structure 21 housed in the central portion 35 of the cup 29, a problem arises, particularly when the assembly of valve structure 21 and container 20 is to be stored for a period of time before use.

To overcome this problem, a seal 36 is positioned across the upper or exterior central portions 37 of mounting cup 29 and such seal 36 is adhered to such central portions 37 by bonding means 38. The seal 36 and the bonding means 38 are each gas tight so as to provide in combination with central portions 37 of cup 29 a hermetic seal. The rim of the seal 36 may be provided with a projection 39 which, in this instance, extends circumferentially therearound. The bonding means 38, however, provides a releasable or separatable attachment serving to separate, or part, in response to an appropriate force applied to projection 39, the seal 36 from the central portions 37 so that the seal 36 is parted from its initial adjacent gas-tight association with the central portions 37 in the assembled valve structure 21. The force so applied to projection 39 can be provided by any convenient prying means, such as a screw driver 40 shown fragmentarily in FIG. 2, or the like. Alternatively, the force can be provided by applying a tilting force in the direction of arrow 41 near the uppermost central portion of the seal 36. The separation thus occurs in a frangible zone defined by a fracture of the bonding means 38 itself, or by a breaking away of the bonding means 38 from one or the other of the seal 36 or the central portions 37, or by some combination thereof, or otherwise, as desired. Such separation is accomplished at the time when the valve structure 21 is to be first used for the dispensing of pressurized material from chamber 34 of container 20.

The bonding means 38, in general, can be provided by any convenient or suitable composition, the exact choice in any given instance being influenced by cost factors, functional requirements of a particular seal construction application, and the like. When the seal 36 is formed, for example, of sheet metal, the releasable bonding means 38 can be comprised of, for examples, (a) a nonmetallic adhesive which is organic or inorganic in composition, (b) a metallic bond, such as a hairline weld, soldered joint, or the like, or (c) some combination of the foregoing, or the like, as desired.

In general, the seal 36 can be comprised of any convenient solid gas impermeable material which will suitably withstand the pressures within the chamber 34 when container 20 is filled and pressurized and which will not rupture or crack during normal storage of a filled and pressured container 20. A presently preferred construction material for a seal member 36 is sheet metal, such as steel, or the like. Care needs to be exercised to be sure that gas-tight sealing is obtained between the bonding means 38, seal 36, and central portions 37. Additionally, care needs to be exercised in the positioning, sizing, structure and bonding strength developed between the seal 36, central portions 37, and bonding means 38 so that the desired release in the region of the frangible zone existing in the vicinity of the bonding means 38 can be achieved through the type of applied force above described.

When, for example, the cup 29 and the seal 36 are comprised of steel, the bonding means 38 can be, for examples, one derived from: (a) a thermoplastic adhesive film (such as "Scotchweld" film 1460 from 3M Co., St. Paul, Minn., presently preferred; or dry film T-1502, which is presently understood to be a polyester film coated with a thermoplastic adhesive, from Sheldahl Co., Northfield, Minn.; or the like); (b) a thermosetting film (such as dry film T-1401, which is understood to be a thermosetting adhesive from Sheldahl Co.), so-called instant bonding, initially liquid adhesives (such as a so-called anaerobic adhesive like "Loctite Superbonder" 430; or "Loctite" 242 adhesive sealant from Loctite Corporation, Newington Conn.; or a cyanoacylate type adhesive such as is available from, for example, Eastman Chemical Co. of Rochester, New York; or the like); (c) a hot metal adhesive (such as "Darex" side seam cement no HMP-8306 from W. R. Grace & Co., Dewey and Almy Chemicals Division, Atlanta, Ga., which is an initially solid material that is melted at about 360° F. and applied as a liquid to at least one of the two surfaces to be bonded together; and the like); and the like. When using an adhesive film, it is presently preferred to prepare a laminate-type assembly of the two components to be bonded together after which an exposed metal surface of one of the components is spot heated, or the like, by a localized heat source to a temperature at least sufficient to effectuate a bonding of metal-to-film-to-metal. A valve 21 is generally preassembled before being associated with a container 20.

As those skilled in the art will appreciate, the internal diameter of the aperture 27 defined by the rolled perimeter 22 can be standardized in the valve trade while the mounting cup 29 is so formed as to have an inner wall member 32 integrally formed with the central portions 37 which wall member 32 can have a diameter and an axial length as particularly chosen for an individual type of valve structure 21 desired.

Through the center of portion 37 and along the axis 30 of the mounting cup 29 is an aperture 42 which can be optionally provided, as in valve assembly 21, with an upstanding lip 43 which serves as a stiffening or reinforcing means about the aperture 42. Through the aperture 42 is extended a nozzle stem member 44 which, at its upper end portion, is provided with a dispensing orifice 45, and which, at its opposite input end portion, is provided with a radially outwardly extending flange 46 that is here integrally formed with the nozzle stem member 44. The nozzle stem member 44 extends also through a central aperture 47 of a resilient elastomeric gasket 48 which gasket 48 also makes abutting contact with both adjacent outer wall portions of the nozzle stem member 44 and the flange 46. The outer perimeter of the gasket 48 is seated in the inner wall member 32 adjacent the central portion 37 of the mounting cup 29. The nozzle stem member 44 is normally in the upright (valve closed) configuration illustrated in FIG. 2.

A moveable cup member 49 is disposed for axial sliding movements in the region of the central portion 35 of the mounting cup 29. The moveable cup member 49 includes a valve plate 51 which transversely (relative to nozzle stem member 44) extends across flange 46. Plate 51 further includes adjacent its outer periphery an integrally formed associated axially upstanding rib portion 52 which annularly extends about the valve plate 51. The rib portion 52, when the valve structure 21 is in its closed configuration as shown in FIG. 2, makes a seating engagement with adjacent portions of the gasket 48.

Also, integrally associated with the valve plate 51, are a plurality of radially (relative to plate 51) outwardly extending guide ribs 53 which are configured so as to be equally sized and equally circumferentially spaced from one another, and the radially outer edges of each rib 53 are in a spaced, adjacent, or even optionally contacting, slidable relationship with respect to adjacent portions of wall 32. In the embodiment shown, the guide ribs 53 extend axially downwardly (towards chamber 34) and rearwardly away from the valve plate 51 to an extent sufficient to stabilize sliding movements of the moveable cup member 49 relative to the mounting cup 29 and prevent cocking of valve plate 51.

Similarly downwardly and rearwardly extends a circumferentially continuous apron 55 integrally from valve plate 51 in a radially inwardly spaced relationship relative to the outer edges of ribs 53. The principal purpose of this apron 55 is to provide support and a point of attachment for the adjacent radially inner terminal portions of individual ribs 53, thereby to provide a reinforcing means for the ribs 53 and the plate 51 in the moveable cup member 49.

The assembled combination of valve 21 and container 20 is adapted for the receipt and storage of either a conventionally pressurized (e.g. about 35 to 40 pounds per square inch) fill or of a highly pressurized (e.g. about 150 psi) fill. When valve 21 is unsealed by the removal of seal 36, as described, the valve 21 can be operated normally through tilting of stem 44. In such valve open configuration, the pressurized contents in the container 20 flow into the interior region of stem 44 through the passageways existing between circumferentially adjacent ribs 53 and radially adjacent portions of wall 32 and apron 55 and out through orifice 45. As those skilled in the art will appreciate, the valve structure 21 in its open configuration provides a cross-sectionally exceedingly large flow capacity therethrough. Valve structure 21 is well adapted for the dispensing of viscous fluids. When closure of valve structure 21 is desired, the tip end 60 is allowed to return to its normally upright configuration which effects a reversal of the valve opening operations described above and results in a resealing between the rib portion 52 and the gasket 48, with resealing being effectuated, in the valve structure 21, by the interior pressure within the container 20.

Thus, it will be appreciated by those skilled in the art that the seal 36 provides hermetic gas-tight tamperproof isolation of the fill in a chamber 34 or an assembly of container 20 and valve 21.

One advantage of the valve structure 21 is that it can be preassembled with the external seal 36 and bonding means 38. The preassembled valve can be stored and then assembled onto a container 20 with the operation being conducted without disturbing the seal 36 or the bonding means 38. Conveniently, a container 20 fitted with a valve structure 21 is filled and pressurized from the bottom (not shown) of a container 20 conventionally.

Figure 4:
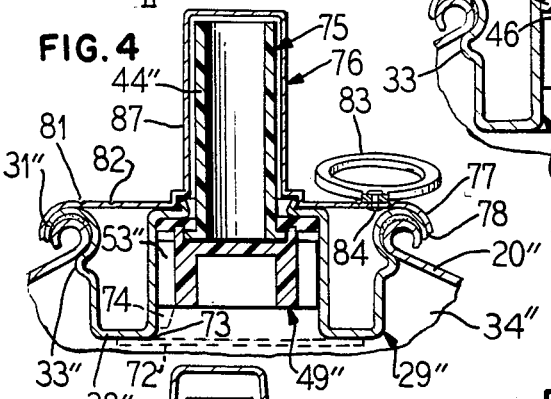
FIG. 4 is a view similar to FIG. 2, but illustrating an alternative embodiment of a valve structure of the present invention.

Optionally, in valve structure 75, as shown in FIG. 4, a seal plate 72 (shown in phantom) may be positioned across the bottom or interior projections 28'' of mounting cup 29'' and such seal plate 72 is adhered to projections 28'' by a releasable bonding means 73. Each of the seal plate 72 and the releasable bonding means 73 are gas tight so as to provide a combination with projections 28'' and cup 29'' a hermetic seal. The releasable bonding means 73, however, provides a releasable or separatable attachment operated to separate, or remove, in response to a force applied thereto in a direction generally urging apart the seal plate 72 from the projections 28'', thereby separating the seal plate 72 from its initial adjacent association with the projections 28'' in the assembled valve structure 75.

The separation can be accomplished by a fracture of the bonding means 73 itself, or by breaking away of the bonding means 73 from one or the other of the seal plate 72 or the projections 28'', some combination thereof, or otherwise, as desired. Such a separation (or rupture) is accomplished at the time when the valve structure 75 is to be first used for the dispensing of pressurized material from chamber 34''.

When such a seal plate 72 and bonding means 73 are employed, one of the guide ribs 53'' is provided with an integrally formed, downwardly depending, eccentric cam lobe 74 (shown in phantom) located adjacent the radially outer edged portion thereof.

When the stem member 44'' is tilted, the lowermost tip portion of cam lobe 74 engages a surface portion of the seal plate 72 in a region thereof in spaced, adjacent relationship to the outer edge of the seal plate 72, thereby to apply a localized, downwardly exerted force against the plate 72. The result is that the bonding means 73 is locally separated or released. As further tilting of valve stem 44'' takes place, the plate 72 is separated completely from association with projections 28'' and the desealing operation is complete. Internal seal means with seal removing means are shown and described in my copending U.S. patent application Ser. No. 442,636 filed Nov. 18, 1982 and now U.S. Pat. No. 4,450,985 issued May 29, 1984 (incorporated by reference).

Figure 3:
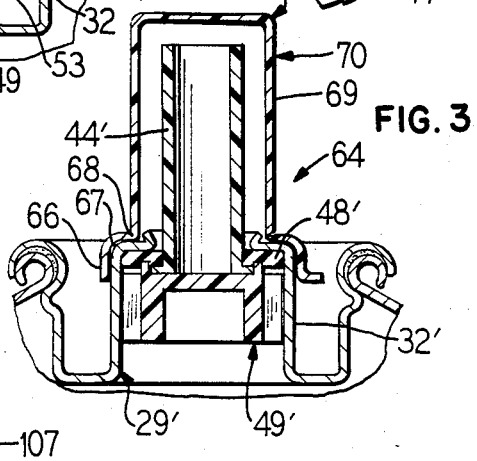
FIG. 3 is a view similar to FIG. 2, but illustrating an alternative embodiment of a valve structure of the present invention.

Referring to FIG. 3, there is seen another embodiment of a valve structure of the present invention which is herein designated in its entirety by the numeral 64. Valve structure 64 is similar to valve structure 21 and corresponding components thereof are similarly numbered but with the addition of prime marks thereto.

In place of seal 36, valve structure 64 employs a cup-shaped seal 65 which may be formed of sheet metal and seal 65 includes a terminal downturned peripheral flange 66 which is adapted to engage inner wall members 32'. Such flanged portions 66 are securely bonded to adjacent portions of the valve body 29' with a non-releasing bonding means 67 such as above described. Here a frangible zone is provided by a coined pathway 68 formed in the juncture between flange 66 and upper portions 69 of the seal 65. The coining defines a weakened area which is rupturable through the application of tilting force applied to upper portions 69 as in the direction of arrow 70 or the like, as desired. As soon as localized rupture is achieved in the coined area, additional pulling action with appropriate force can be employed to complete separation of upper portions 69 from flange 66, thereby permitting complete removal of the upper portions 69.

Figure 5:
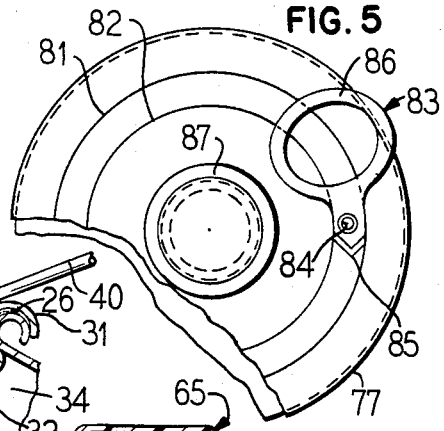
FIG. 5 is a fragmentary plan view of the embodiment shown in FIG. 4.

Referring to FIGS. 4 and 5, there is seen still another embodiment of the valve structure of the present invention which is herein designated by the numeral 75. Valve structure 75 is similar to valve structure 21 and corresponding components thereof are similarly numbered but with the addition of double prime marks thereto. In place of seal 36, valve structure 75 employs a broad rimmed seal 76 which may be formed of sheet metal and seal 76 includes a peripheral rim portion 77 which is adapted to matingly nest over rolled perimeter 31'' to which it is adhered in a permanent manner by a bonding means 78 such as an adhesive, a weldment, or the like. The seal 76 thus hermetically seals the entire upper exposed portion of the valve 75 in combination with the sealing means 76.

The flat region of rim portion 77 is provided with a pair of radially spaced, annularly extending, coined pathways designated 81 and 82, respectively. A pull tab 83 is secured in the region between the pathways 81 and 82 to the rim portion 77 by means of a rivet 84. A weakened coined area generally radially extending and designated by the numeral 85 is provided in the region immediately leading the tab 83. Thus, when the handle portion 86 of the tab 83 is raised, as by the finger of an operator, the coined area 85 is ruptured and severance is achieved along the pathways 81 and 82 as the tab is upwardly pulled away from the rib portions 77, thus permitting the complete severance of the upper portions 87 from the rim portion 77, and, after such removal is completed, the valve 75 can be operated in its intended manner.

As those skilled in the art will appreciate, since the seal 76 extends over rolled perimeter 31", the seal 76 cannot be installed until after the valve structure 75 has been installed in functional association with a container 20" with the use of collet fingers or the like. The installed valve can then, if desired, be used for filling the container 20" as through the stem 44", as those skilled in the art will appreciate, as an alternative to bottom filling of the container 20". Thereafter, the seal 76 with bonding means 78 can be installed and associated with the valve mounting cap 29".

Figure 6:
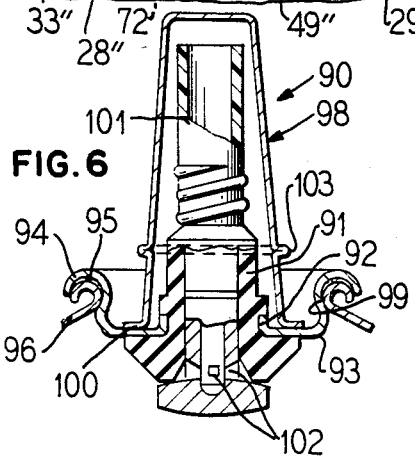
FIG. 6 is an enlarged vertical sectional view of an alternative embodiment of a valve structure of the present invention.

Referring to FIG. 6, there is seen another type of valve assembly (compared to the valve assembly types shown in the proceeding FIGS. 2–5) which valve assembly is designated in its entirety by the numeral 90. The valve assembly 90 incorporates a conventional type of elastomeric, resilient tubular sealing plug 91 which extends through an aperture 92 centrally formed in a metallic cup-like valve body 93. The peripheral edge regions of the valve body 93 are formed into a rolled lip 94 whose interior surface portions are provided with an elastomeric sealing layer 95 so that the rolled lip 94 can be conventionally mounted over mating portions across the mouth 99 of a dispensing container 96 with collet fingers.

A seal 98 is fitted over externally exposed components of the valve assembly 90 associated with valve body 93 and the rim or terminal portions of the seal 98 are releasably bonded in gas-tight relationship to adjacent portions of the body 93 by bonding means 100, the bonding means 100 in composition being, for example, an organic or inorganic adhesive composition, or the like, as desired.

In normal (unsealed) operation of valve assembly 90, when the stem 101 of the valve assembly 90 is tilted, the sealing plug 91 is distorted and the access ports 102 formed in the lower portions of the valve stem 101 are exposed, thereby permitting a fill within a container 96 to enter ports 102 and to be dispensed through the hollow interior of stem 101.

To accomplish unsealing of valve 90, force is transversely applied to the upper end of the seal 98 which is sufficient to break the bonding means 100 between the rim portions of the sealing plate 98 and the valve body 93 resulting in the separation of the seal 98 from the valve body 93.

Alternatively, a pry instrument, such as screw driver or the like, can be levered against a projection 103 formed in seal 98 to dislodge the seal 98 from the valve body 93.

Figure 7:
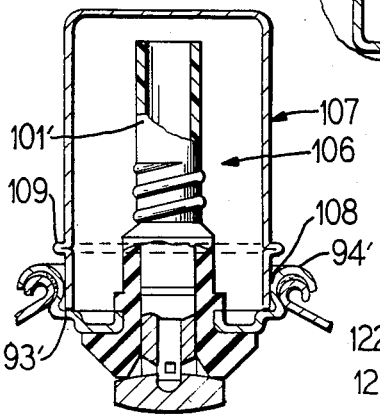
FIG. 7 is a view similar to FIG. 6, but illustrating an alternative embodiment of an external sealing arrangement.

Referring to FIG. 7, there is seen another valve assembly 106, which is comparable to the valve assembly 90 shown in the preceding FIG. 6, and corresponding components thereof are similarly numbered but with the addition of prime marks thereto. In place of seal 98, the valve structure 106 employs a seal 107 which may be formed of sheet metal or the like and the seal 107 includes a terminal portion which is adhered to adjacent portions of the rolled lip 94' by a bonding means 108, such as an adhesive, weldment, or the like. The seal 107 also can be removed, if desired, by a pry instrument, such as a screw driver, or the like, which is levered against a projection 109 formed in the seal 107 to dislodge the seal 107 from the valve body 93'.

Figure 8:
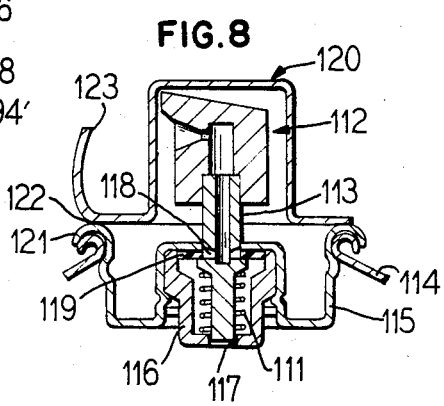
FIG. 8 is a vertical sectional view of a further alternative embodiment of a valve structure of the present invention.

Referring to FIG. 8, there is seen another type of valve assembly which valve assembly is herein designated in its entirety by the number 112. Valve assembly 112 is of the type wherein, when the valve stem assembly 113 thereof is vertically depressed against principally the yielding bias of a spring 111, there is opened a flow path for a pressurized fill being dispensed from a container 114 with which the cup 115 of the valve 112 is attached through valve body 116 from fill entry port 117 to a plurality of exposed access ports 118 in valve stem assembly 113, the sealing gasket 119 normally covering the ports 118 when the valve assembly 112 is in its closed configuration, as shown in FIG. 8. By the present invention, valve assembly 112 is provided with an exterior seal 120 which is releasably bonded to the rolled perimeter 121 of mounting cup 115 by a bonding means 122 which initially secures peripheral portions of the seal 120 to adjacent portions of rolled perimeter 121. The exterior seal 120 is provided an integral pull tab 123 which, when a pulling force is applied thereto, causes separation of seal 120 from the rolled perimeter 121 by fracturing of the bonding means 122.

Figure 9:
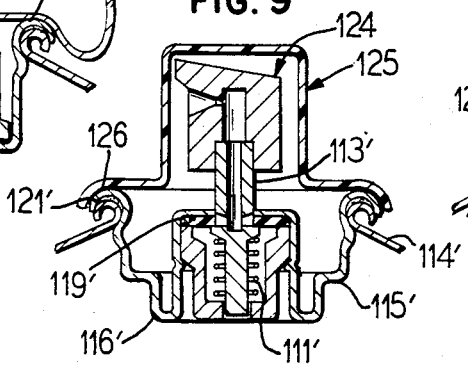
FIG. 9 is a vertical sectional view of a further alternative embodiment of a valve structure of the present invention.

Referring to FIG. 9, there is seen a valve assembly which is similar to the valve assembly 112 of FIG. 8, but which is here designated in its entirety by the numeral 124. Components of the valve assembly 124 which are similar to the corresponding components in valve assembly 112 are similarly numbered but with the addition of prime marks thereto. The valve assembly 124 is provided with an exterior seal 125 which is releasably bonded to the rolled perimeter 121' of the mounting cup 115' by a bonding means 126 which initially secures the peripheral portions of the seal 125 to adjacent portions of the rolled perimeter 121'. The peripheral contouring of the seal 125 permits a larger surface area of the seal 125 to be bonded to the rolled perimeter 121' of the mounting cup 115' than is achieved in the assembly 112 with seal 120. Such a larger area of contact can be used to provide a better seal between the valve cup 115' and the exterior seal 125.

Figure 10:
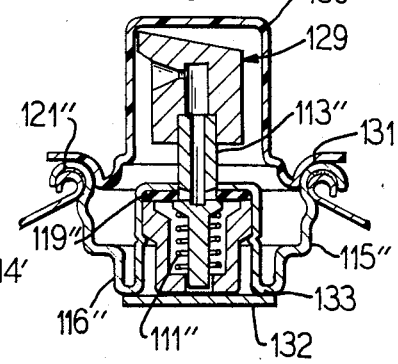
FIG. 10 is a vertical sectional view of a further alternative embodiment of a valve structure of the present invention.

Referring to FIG. 10, there is seen a valve assembly 129 which is similar to the valve assembly 112 of FIG. 8 and components of valve assembly 129 are similarly numbered but with the addition of double prime marks thereto. The valve assembly 129 is provided with an exterior seal 130 which is releasably bonded to the rolled perimeter region 121" of the mounting cup 115" by a bonding means 131 which initially secures the peripheral portions of the seal 130 to adjacent portions of the rolled perimeter 121". The peripheral contouring of the seal 130, like the peripheral contouring of the seal 125 of FIG. 9, permits a larger surface area of the seal 129 to be bonded to the rolled perimeter 121" than is achieved in the valve assembly 112 with seal 120.

Valve assembly 129 is additionally provided with an internal seal 132 which is hermetically sealed to internal projections of valve body 116" by bonding means 133. Initial downward movement of valve stem assembly 113" after the external seal 130 is opened results in sufficient pressure being applied against internal seal 132 to break the bonding means 133 and thereby permit the normal operation of valve assembly 129 to take place for fill dispensing operations.

The use of a combination of internal and external seals in a valve assembly of this invention can be advantageous when a fill of high purity, a fill which is readily contaminated by atmospheric gases or a use environment, a fill of great reactivity or poor storage capability, or the like, is involved. The internal/external seal combination permits storing before use of a fill to be dispensed from an aerosol container or the like in a sterile environment under sealed conditions.

Figure 11:
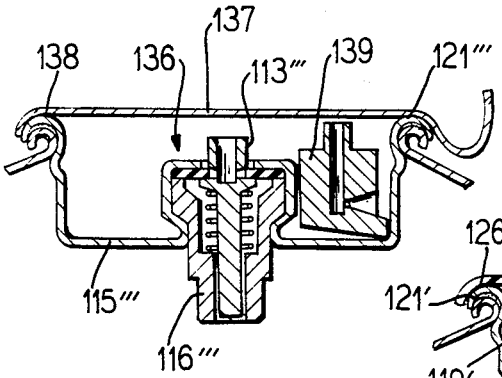
FIG. 11 is a vertical sectional view through a further alternative embodiment of a valve structure of the present invention.

FIG. 11 illustrates a further embodiment of a valve structure of the present invention which is designated in its entirety by the numeral 136 and which is similar to valve assembly 112 of FIG. 8 (and like parts are similarly numbered, but with the addition of triple prime marks thereto). The valve body 116''' is configured so as to permit the moving components of structure 136 to be stored before use beneath an external seal 137 which is sealed across the rolled perimeter 121''' of valve body 116''' by releasable sealing means 138. The nozzle head member 139 is configured so as to make reversable nesting sliding engagement with the central portion of stem assembly 113''', and, when the seal 137 is installed, the member 139 is removed and stored adjacent to stem assembly 113''' in the space between central and peripheral portions of valve body 116'''. When the seal 137 is later removed, as through application of separating force applied to sealing means 138 through a tab integrally formed with seal 137, the member 139 is slidably engaged with stem assembly 113''' to complete assembly of valve structure 136.

One presently preferred class of valve for use in the practice of the present invention comprises valves having a tiltable stem in combination with a moveable cup, particularly such valves of this type which have a high flow capacity such as are shown in FIGS. 1 through 4 and described herein. For additional valves of this general type, see the teachings of my copending U.S. patent application Ser. Nos. 394,517 filed July 2, 1982; 405,696 filed Aug. 5, 1982, now U.S. Pat. No. 4,418,847, issued Dec. 6, 1983; 432,298 filed Oct. 1, 1982; and 438,212 filed Nov. 1, 1982; the disclosure of each of which is entirely incorporated hereinto by reference.

Although the teachings of my invention have herein been discussed with reference to specific embodiments, it is to be understood that these are by way of illustration only and that others may wish to utilize my invention in different designs or applications.

I claim:

1. An aerosol-type dispensing device comprising a fluid dispensing valve structure in combination with a pressurizable container, said valve structure being adapted to dispense the fill contents of said container, said valve structure comprising:

valve mounting cap having (a) a perimeter region which terminates in a rolled lip that is sealingly secured over a mating rolled lip formed about the mouth of said pressurizable container, (b) a central portion with an aperture defined therein, and (c) generally continuous wall portions extending between said central portion and said perimeter region and defining therebetween a cavity adapted for receipt thereinto of crimp forming means;

an elongated tubular nozzle means having a dispensing orifice in one end thereof and having a second end extending through said aperture;

resilient valve seat means positioned in said valve mounting cup body;

a movable valve means biasable against said valve seat means to close said valve structure, said movable valve means comprising a moveable cup that is slidably longitudinally reciprocal within portions of said valve body responsively to tilting movement of said one end of tubular nozzle means;

said tubular nozzle means being moveable and having said second end thereof adapted for moving said moveable valve means to open said valve structure;

said resilient valve seat means comprising a gasket circumferentially disposed about said second end of said tubular nozzle means whereby when said one end is tilted relative to said valve mounting cup body, said moveable cup is moved from said gasket, thereby to permit flow of said fill contents through said tubular nozzle means;

a gas-tight sealing member comprised of sheet metal and having a central region which is positioned over said tubular nozzle means and having peripheral portions positioned in spaced adjacent relationship to said central portion, and in contacting adjacent relationship to said perimeter region;

a gas-tight sealing means securing said peripheral portions to portions of said perimeter region;

a frangible zone extending in a closed pathway generally adjacent said central portion and defined in at least one of said sealing member and said sealing means, said frangible zone being rupturable in response to applied localized external force, whereby at least said central region is removable from said central portion and said nozzle means.

2. The dispensing device of claim 1 wherein said frangible zone is defined by said sealing means.

3. The dispensing device of claim 1 wherein said peripheral portions are positioned in radially inner adjacent relationship to said perimeter region.

4. The dispensing device of claim 1 wherein said sealing member has tab means associated therewith for applying an external force against said sealing member.

5. An aerosol-type dispensing device comprising a fluid dispensing valve structure in combination with a pressurizable container, and said valve structure being adapted to dispense fill contents of said container, said valve structure comprising:

a valve mounting cup having (a) a perimeter region which terminates in a rolled lip that is sealingly secured over a mating rolled lip formed about the mouth of said pressurizable container, (b) a central portion with an aperture defined therein, and (c) generally continuous wall portions extending between said central portion and said perimeter region and defining therebetween a cavity adapted for receipt thereinto of crimp forming means;

an elongated tubular nozzle means having a dispensing orifice in one end thereof and having a second receiving end extending through said upper aperture;

resilient valve seat means positioned in said valve mounting cup body;

a moveable valve means biasable against said valve seat means to close said valve structure;

said tubular nozzle means being moveable and having said second end thereof adapted for moving said moveable valve means to open said valve structure;

a gas-tight sealing member comprised of sheet metal and having a central region which is positioned over said tubular nozzle means and having peripheral portions positioned in spaced adjacent relationship to said central portion, and in contacting adjacent relationship to said perimeter region;

a gas-tight sealing means securing said peripheral portions to portions of said perimeter region;

a frangible zone extending in a closed pathway generally adjacent said central portion and defined in at least one of said sealing member and said sealing means, said frangible zone being rupturable in response to applied localized external force, said frangible zone being defined by a pair of radially spaced but adjacent coined regions formed in said sealing member and wherein lever means is provided for applying localized force to at least a portion of the area between said coined regions whereby said sealing member is rupturable in said area whereby at least said central region is removable from said central portion and said nozzle means.

6. The dispensing device of claim 5 wherein said sealing means comprises an adhesive composition.

7. The dispensing device of claim 5 wherein said sealing means comprises a metal.

8. The dispensing device of claim 7 wherein said metal is a weld.

9. The dispensing device of claim 7 wherein said metal is a solder.

10. An aerosol-type dispensing device comprising a fluid dispensing valve structure in combination with a pressurizable container, and said valve structure being adapted to dispense fill contents of said container, said valve structure comprising:

a valve mounting cup having (a) a perimeter region which terminates in a rolled lip that is sealingly secured over a mating rolled lip formed about the mouth of said pressurizable container, (b) a central portion with an aperture defined therein, and (c) generally continuous wall portions extending between said central portion and said perimeter region and defining therebetween a cavity adapted for receipt thereinto of crimp forming means;

an elongated tubular nozzle means having a dispensing orifice in one end thereof and having a second receiving end extending through said upper aperture;

resilient valve seat means positioned in said valve mounting cup body;

a moveable valve means biasable against said valve seat means to close said valve structure;

said tubular nozzle means being moveable and having said second end thereof adapted for moving said moveable valve means to open said valve structure;

a gas-tight sealing member comprised of sheet metal and having a central region which is positioned over said tubular nozzle means and having peripheral portions positioned in spaced adjacent relationship to said central portion, and in contacting adjacent relationship to said perimeter region;

a gas-tight sealing means securing said peripheral portions to portions of said perimeter region;

a frangible zone extending in a closed pathway generally adjacent said central portion and defined in at least one of said sealing member and said sealing means, said frangible zone being rupturable in response to applied localized external force, whereby at least said central region is removable from said central portion and said nozzle means; and an internal sealing means which is peripherally slidingly engaged with said valve body and which is separatable therefrom by movement of said tubular nozzle means after said central region has been opened.

* * * * *